United States Patent [19]

Duchêne et al.

[11] 4,185,780

[45] Jan. 29, 1980

[54] POWDER-DISTRIBUTING DEVICE

[75] Inventors: Alain Duchêne, Pierrevert; Jean-Claude Malet, Aix-en-Provence; Francis Neu, Villeneuve d'Ascq, all of France

[73] Assignees: Commissariate a l'Energie Atomique; S.A. des Establissements NEU, both of France

[21] Appl. No.: 845,859

[22] Filed: Oct. 27, 1977

[30] Foreign Application Priority Data

Oct. 29, 1976 [FR] France ..... 76 33658

[51] Int. Cl.[2] ..... B05B 1/14

[52] U.S. Cl. ..... 239/553.5; 239/590.5

[58] Field of Search ..... 239/553.3, 533.5, 590.3, 239/590.5, 654; 302/61, 63; 55/385 R

[56] References Cited

U.S. PATENT DOCUMENTS

| | | | |
|---|---|---|---|
| 1,641,149 | 9/1927 | Bernert | 302/63 |
| 4,043,397 | 8/1977 | Glowienke | 239/553.5 X |

*Primary Examiner*—Robert W. Saifer

*Attorney, Agent, or Firm*—Thomas J. Greer, Jr.

[57] ABSTRACT

A duct having the shape of a pyramid frustum for the flow of powder in suspension in a carrier gas is of increasing width and decreasing height in the downstream direction. The duct has a solid end-wall and a wall provided with an opening between the open upstream base joined to a supply pipe and a solid portion joined to the open downstream base so as to form a spray-discharge nozzle. The device comprises a screen having holes for the discharge of carrier gas and a grid formed by flat partitions. Inclined deflectors extend transversely within the duct in the vicinity of the opening, the angle of inclination being of increasing value from the upstream end to the downstream end.

6 Claims, 4 Drawing Figures

POWDER-DISTRIBUTING DEVICE

This invention relates to installations for storage, transportation and distribution of powder by pneumatic means, the powder being in suspension in a carrier fluid consisting of a gas. These installations are primarily intended to extinguish sources of fires and more especially fires involving liquid metals consisting in particular of sodium.

In known manner, an installation of this type usually comprises a reservoir in which the powder is stored and which is provided at the upper end with a loading hopper or orifice and at the lower end with at least one discharge orifice connected to a pneumatic transfer duct. Said duct is usually provided with a series of branch pipes and with spraying devices fixed at the end of these latter or else is provided with an extension in the form of a flexible or rigid pipe, a device of this type being fitted on the end of said pipe.

Installations of this type are also known for the transfer of liquid or powdered products which are distributed by means of spraying devices provided as a general rule with one or a number of suitably calibrated and oriented orifices. Spraying devices of this type, however, do not permit of homogeneous projection over a large surface. Above all, they are incapable of operating in a satisfactory manner in the case of powders which have a low degree of flowability, especially powders which have high particle cohesion as well as a high natural slope or angle of repose.

The present invention is more especially concerned with a movable or stationary distributing device which can be mounted on the end of a flexible or rigid pipe and in which is circulated a two-phase mixture constituted by a suspension of powder in a gas which is preferably inert, said device being intended to be employed in all positions with any orientation with respect to a vertical plane.

The invention is more especially directed to a distributing device of this type for spraying a powder having a high degree of cohesion onto a surface area which may be flat or of any other shape in order to form a uniform layer having a large area in which the proportion of carrier gas is minimized, the powder being sprayed at low velocity after being freed from the gas.

To this end, the device under consideration comprises a hollow duct mounted at the end of a pipe and open at both ends for the flow of a powder in suspension in a carrier gas. The device is essentially distinguished by the fact that said duct is constituted by a pyramid frustum formed by four lateral walls, by an open base which is located upstream with respect to the direction of flow of the powder and connected to the pipe and by an open base located downstream. The width of the transverse cross-section of the pyramid frustum aforesaid increases from the upstream end to the downstream end whilst the height decreases, also from the upstream end to the downstream end. Said pyramid frustum comprises a first solid end wall and a second opposite wall provided with an opening which is cut-out in said second wall between the upstream base which is connected to the pipe and a solid portion connected to the downstream base in order to define a nozzle at the end of the duct through which said powder is sprayed. The device aforesaid further comprises a perforated screen joined to the opening of the second wall and provided over the entire surface thereof with holes through which the carrier gas is discharged. Provision is also made for a grid formed by flat partitions located at right angles to the solid wall and extending from the nozzle into said opening at the upstream end and for a series of flat deflectors which are oriented obliquely and inclined towards the first solid wall. Said deflectors extend transversely within said duct and in the vicinity of the opening which is cut-out in the second wall. The angle of inclination is variable from one deflector to the next and increases in value according to the positions of said deflectors from the upstream end to the downstream end.

The arrangements in accordance with the invention consist especially in making use of a hollow duct having the shape of a pyramid frustum open at both ends and becoming progressively wider and narrower from the upstream end to the downstream end and also in mounting within said duct a series of inclined deflectors and a grid in the vicinity of the discharge nozzle which produce two combined effects in the flow of powder in suspension in the turbulent state. These combined effects result in the achievement of the desired objectives, namely a uniform distribution of the projected powder, maximum removal of the entrained carrier gas and finally a projection velocity which is reduced to the minimum value required. In fact, by virtue of the presence of inclined deflectors, the flow of powder which passes into the base of the duct located upstream is abruptly deflected towards the solid wall, rebounds from this latter, again encounters an inclined deflector and so on in sequence. As a result of successive expansions, the repeated impacts thus produced permit effective separation of the powder from the carrier gas which is then permitted to escape freely through the holes of the perforated screen and is distributed outside the hollow duct. Moreover, by making use of a grid constituted by vertical walls which form an extension of the nozzle located downstream, the flow of powder is suitably distributed over the entire width of the duct while permitting in particular a uniform and homogeneous projection at a maximum angle of dispersion.

In accordance with another distinctive feature, the flat partitions of the grid extend within the opening of the second wall to the immediate proximity of the inclined deflector which is located furthest downstream in the series.

In accordance with yet another distinctive feature, the hollow duct is provided with at least one complementary deflector placed in the vicinity of the first solid wall and oriented obliquely towards the second opposite wall. The complementary deflector extends transversely within the hollow duct over all or part of the width of said duct.

In accordance with a preferred embodiment of the invention, the hollow duct comprises a complementary deflector carried by the first solid wall and mounted between two flat inclined deflectors placed in the vicinity of the opening of the opposite wall.

Finally and in accordance with another advantageous feature, the hollow duct is provided with an outer casing which is open at the downstream end and partly surrounds said duct so as to extend around the perforated screen and to guide the particles of powder which are entrained by the carrier gas.

Further distinctive features of a device for distributing powder as constructed in accordance with the invention will become apparent from the following description of one exemplified embodiment which is given by way of indication and not in any limiting sense, reference being made to the accompanying drawings, in which.

Figure 1:
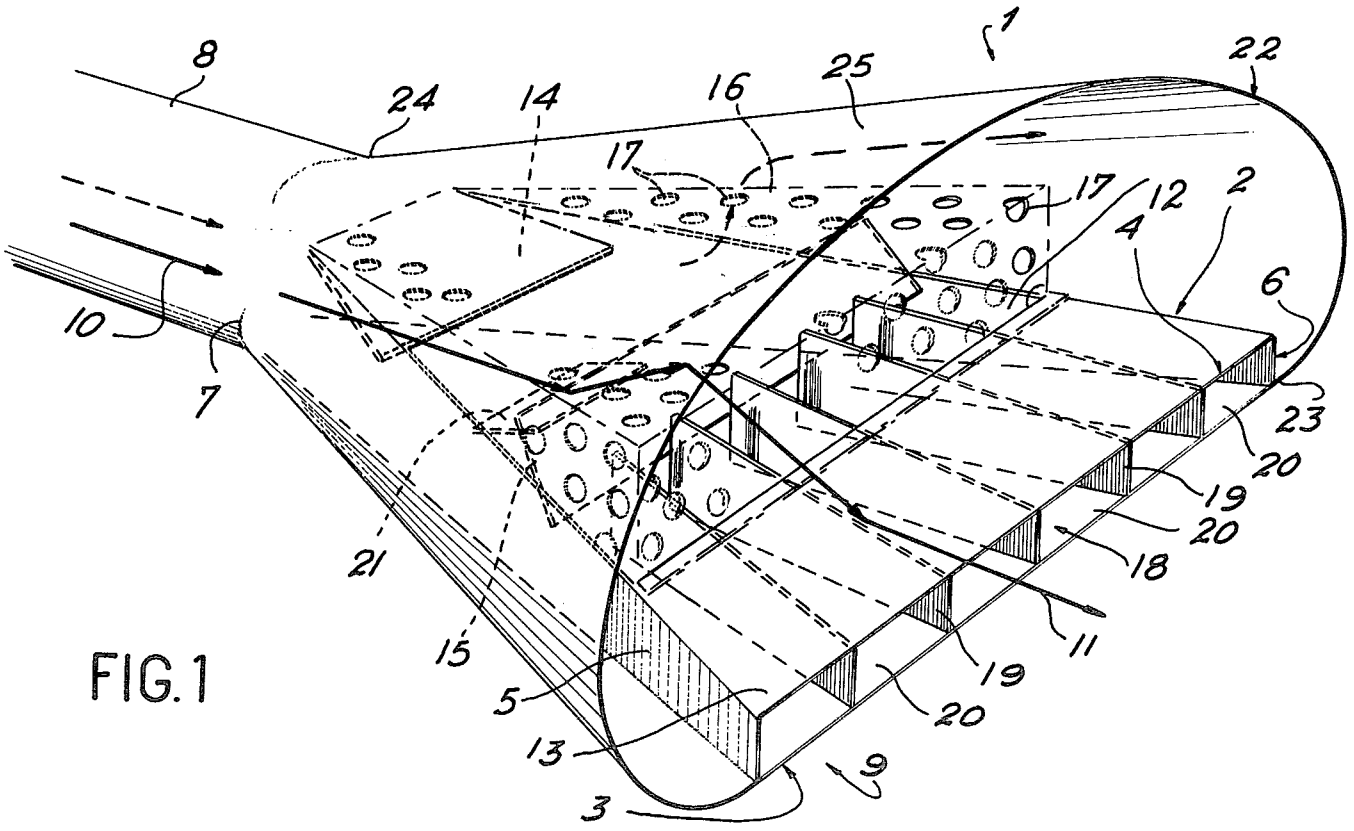
FIG. 1 is a diagrammatic view in perspective showing a distributing device in accordance with a first embodiment of the invention.
Figure 2:
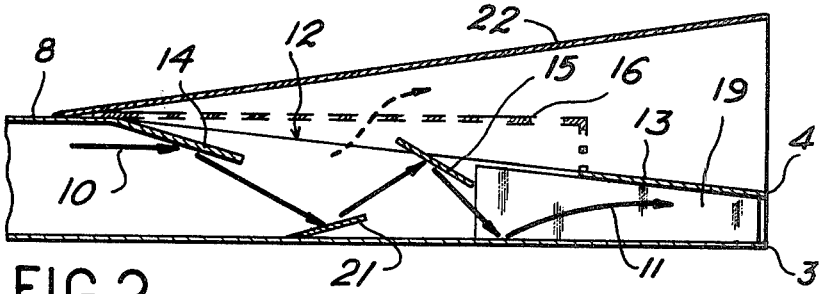
FIG. 2 is a longitudinal sectional view to a smaller scale showing the device in accordance with FIG. 1.

As shown in FIGS. 1 and 2, the device under consideration for distributing a powder in suspension in a carrier gas is generally designated by the reference numeral 1 and mainly comprises a hollow duct 2 having the shape of a pyramid frustum constituted by four lateral walls, especially a solid wall 3 and an opposite wall 4 which are joined together by means of side walls 5 and 6 respectively. Said pyramid frustum is provided at one end with a small base 7 which is connected so as to form an extension of a pipe 8. Depending on the different applications of the device, said pipe 8 can be either stationary or movable, rigid or flexible, in order to permit the use of the device in any position with respect to the vertical direction, especially at the end of a connecting pipe in a portable apparatus or a fixed installation. At the opposite end, the hollow duct 2 has a second base 9 from which the projected powder is discharged, the shape of the pyramid frustum being chosen so as to ensure that in transverse section from the first base 7 to the second base 9, this section is both of increasing width and decreasing height. The downstream direction of flow of the powder is designated in the drawings by the reference numerals 10 and 11, respectively at the base 7 of the duct at the inlet of this latter and at the base 9 of the duct at the discharge end of this latter.

In accordance with an important feature of the distributing device, the wall 4 of the duct 2 which is opposite to the solid wall 3 is provided with a wide opening 12 extending from the upstream base 7 towards the downstream base 9 but limited at a predetermined distance from this latter while allowing a solid portion 13 to remain in the wall 4. A narrow nozzle through which the powder to be projected is discharged from the apparatus is thus formed with the corresponding opposite end of the wall 3.

Provision is also made within the duct 2 and in the vicinity of the opening 12 for a series of inclined deflectors which are two in number in the embodiment illustrated in FIGS. 1 and 2 and are designated by the reference numerals 14 and 15. Said deflectors extend transversely within the duct in relatively spaced relation and are rigidly fixed to the lateral walls 5 and 6 of said duct. Said deflectors have a variable inclination in the direction of the solid wall 3, this inclination being chosen so as to increase from the upstream end to the downstream end, the deflector 14 being thus inclined towards the wall 3 at a smaller angle than the deflector 15.

In accordance with an important feature of the invention, the opening 12 formed in the wall 4 is surmounted by a perforated screen 16 which covers said opening. Said screen is provided with a plurality of holes 17 which are arranged in spaced relation over the entire surface of this latter and occupy approximately 50% of said surface in the example under consideration. As will become apparent hereinafter, said holes 17 are intended to permit the escape of the greater part of the carrier gas, thus ensuring the flow of powder within the duct from the upstream end to the downstream end of this latter.

At the downstream end and in the vicinity of its base 9, the duct 2 is provided with a grid 18 formed by a series of radial partitions 19 which extend at right angles to the solid wall 3. In particular, said partitions subdivide the duct nozzle into a series of small adjacent ducts 20 in which the flow of powder supplied from the admission pipe 8 is distributed in a uniform and homogeneous manner. In addition, said grid also makes it possible to obtain maximum dispersion of the powder at the discharge end of the duct. As an advantageous feature, the radial partitions 19 of the grid 18 extend beyond the duct nozzle at the upstream end within the opening 12 and beneath the perforated screen 16 so as to terminate in the immediate vicinity of that deflector 15 which is nearest the downstream end.

Figure 3:
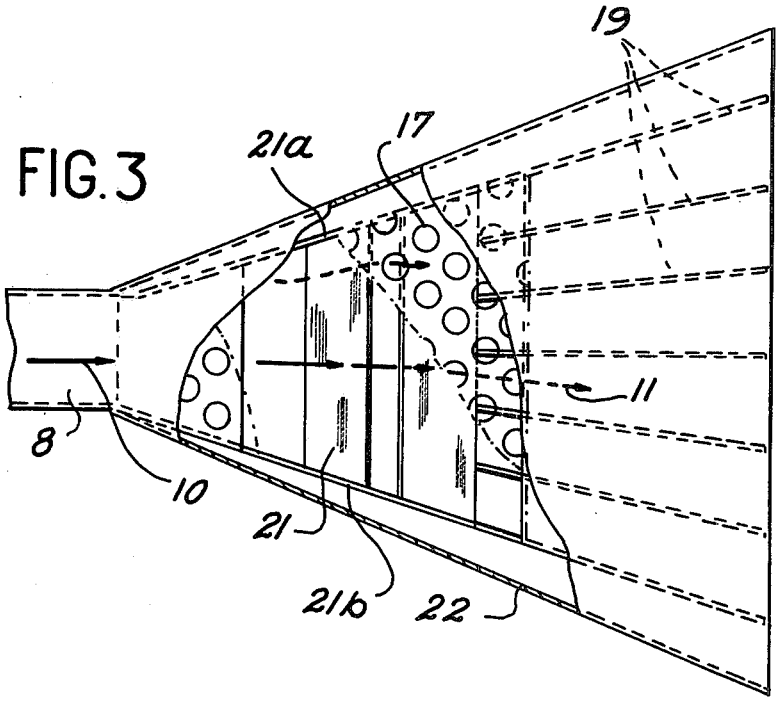
FIG. 3 is a plan view of a distributing device which is similar to that of FIG. 1 but comprises a detail modification.

Preferably, the duct 2 is further provided with at least one additional deflector 21 which, in contrast to the above-mentioned deflectors 14 and 15, is placed in the vicinity of the solid wall 3 while being also inclined to the axis of the duct but directed in this case towards the wall 4. In the exemplified embodiment which is illustrated in FIGS. 1 and 2, said deflector 21 extends transversely over only part of the width of the duct. On the other hand, in the alternative embodiment shown in FIG. 3, the deflector 21 occupies the entire width of the duct and is rigidly fixed to the lateral walls 5 and 6 by means of the edges 21*a* and 21*b* respectively of said deflector.

Finally, the equipment of the powder-distributing device under consideration is completed by means of an outer casing 22, the extremity 23 of which is rigidly fixed to the lateral edges of the solid wall 3 and surrounds the duct 2 at a substantial distance above this latter, especially above the perforated screen 17. Said casing 22 is rigidly fixed to the pipe 8 at the opposite extremity 24 and has a suitably profiled flared wall 25.

The operation of the powder-distributing device hereinabove described can readily be deduced from the foregoing. The rigid or flexible pipe 8 which may be either stationary or movable and has any desired orientation is supplied with a two-phase mixture of powder in suspension in an inert carrier gas, said powder being intended to flow within said pipe from the upstream end to the downstream end and to be discharged into the interior of the hollow duct 2. The flow of powder within said duct strikes the first inclined deflector 14 which returns it towards the solid wall 3 or the deflector 21 against which the powder rebounds, encounters the second deflector 15, is again returned towards the wall 3 and finally discharged through the interior of the end nozzle of the apparatus.

In this path of travel, the carrier gas which causes the powder to flow is progressively separated from this latter by means of successive expansions resulting from repeated impacts and is thus capable of escaping through the opening 12 in the direction of the perforated screen 16 whilst the holes 17 formed in this latter make it possible for the gas to escape freely to the exterior. By virtue of the flared portion 25 of the casing 22 which surrounds the screen 16, the suspensions of powder particles which are entrained with the gas can be suitably guided towards the exterior. However, the proportion of powder entrained represents only an extremely small fraction of the total flow, for example of the order of 1 to 2%. The flow of powder which has thus been freed from the greater part of the carrier gas then reaches the level of the vertical walls 19 which constitute the grid 18 and is divided into a number of flow streams corresponding to the number of small ducts 20 for guiding the powder to the end of the discharge nozzle. The powder is then projected onto the surface to be covered in a uniform manner and at minimum velocity after having previously been freed from the carrier gas in a proportion of at least ⅔ approximately.

Figure 4:
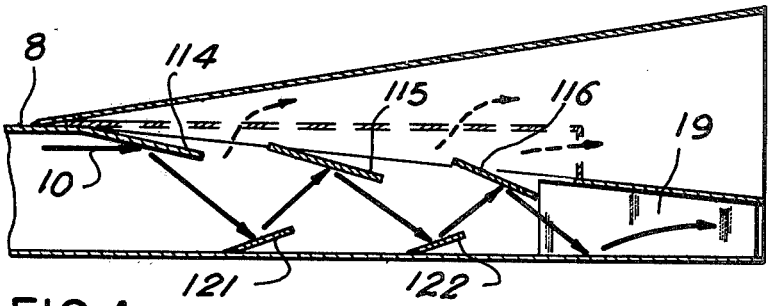
FIG. 4 is another sectional view of the same device in accordance with an alternative embodiment.

In another alternative embodiment of the powder-distributing device shown in FIG. 4, the general arrangements described in the foregoing are again shown. In this example, provision is made in the vicinity of the wall 4 for a larger series of inclined deflectors 114, 115 and 116 respectively and also for two complementary deflectors 121 and 122 in the vicinity of the solid wall 3. As a result, the number of deflectors can be variable according to the characteristics of utilization of the apparatus and especially according to the nature of the powder to be projected and the flow velocity adopted.

In all cases, these deflectors have the double effect of slowing-down the flow of powder while producing maximum removal of the carrier gas as a result of successive expansions. Projection of the powder then takes place at the end of the duct in a uniform and homogeneous manner, irrespective of the orientation of the duct and of the surface to be covered. The device thus finds a particularly advantageous application for extinguishing sources of fires and especially sodium fires; the powder can be projected both onto a flat surface and onto any other object contained within an enclosure or the like. In particular, regions which are not readily accessible can be reached under optimum conditions in all cases.

It is readily apparent that the invention is not limited to the exemplified embodiments which have been more especially described within reference to the accompanying drawings and extends on the contrary to all alternative forms.

What we claim is:

1. A powder-distributing device comprising a hollow duct open at both ends and mounted at the end of a pipe for the flow of a powder in suspension in a carrier gas, wherein said duct is constituted by a pyramid frustum formed by four lateral walls, by an open base which is located upstream with respect to the direction of flow of the powder and connected to the pipe and by an open base located downstream, the transverse cross-section of the pyramid frustum aforesaid being of increasing width from the upstream end to the downstream end and of decreasing height also from the upstream end to the downstream end, a first end wall of said pyramid frustum being solid and a second opposite wall thereof being provided with an opening cut-out in said second wall between the upstream base which is connected to the pipe and a solid portion connected to the downstream base in order to define a nozzle at the end of the duct through which said powder is sprayed, the device aforesaid being further provided with a perforated screen joined to the opening of the second wall and provided over the entire surface thereof with holes through which the carrier gas is discharged, provision being also made for a grid formed by flat partitions located at right angles to the solid wall and extending from the nozzle into said opening at the upstream end and for a series of flat deflectors oriented obliquely and inclined towards the first solid wall, said deflectors being adapted to extend transversely within said duct and in the vicinity of the opening which is cut-out in the second wall, the angle of inclination being variable from one deflector to the next and of increasing value according to the positions of said deflectors from the upstream end to the downstream end.

2. A powder-distributing device according to claim 1, wherein the flat partitions of the grid extend within the opening of the second wall to the immediate proximity of the inclined deflector which is located furthest downstream in the series.

3. A powder-distributing device according to claim 1, wherein the hollow duct is provided with at least one complementary deflector placed in the vicinity of the first solid wall and oriented obliquely towards the second opposite wall.

4. A powder-distributing device according to claim 3, wherein the compelmentary deflector extends transversely within the hollow duct at least over part of the width of said duct.

5. A powder-distributing device according to claim 3, wherein the hollow duct comprises a complementary deflector carried by the first solid wall and mounted between two flat inclined deflectors placed in the vicinity of the opening of the opposite wall.

6. A powder-distributing device according to claim 1, wherein the hollow duct is provided with an outer casing which is open at the downstream end and partly surrounds said duct so as to extend around the perforated screen and to guide the particles of powder entrained by the carrier gas which escapes through the holes of the perforated screen.

* * * * *